United States Patent [19]

Bian

[11] 4,360,206

[45] Nov. 23, 1982

[54] MITT AND TARGET FOR CATCHING A BALL

[76] Inventor: Donald J. Bian, 549 Spring Rd., Elmhurst, Ill. 60126

[21] Appl. No.: 246,686

[22] Filed: Mar. 23, 1981

[51] Int. Cl.[3] ..... A63B 63/00

[52] U.S. Cl. ..... 273/344; 273/412; 273/DIG. 25

[58] Field of Search ..... 273/412, 344, DIG. 25, 273/346

[56] References Cited

U.S. PATENT DOCUMENTS

| | | | |
|---|---|---|---|
| 2,167,775 | 8/1939 | Price | 273/344 |
| 2,187,524 | 1/1940 | Price | 273/344 |
| 2,466,502 | 4/1949 | Stiller | 273/344 X |
| 3,032,345 | 5/1962 | Lemelson | 273/346 |
| 3,141,173 | 7/1964 | Jackson et al. | 2/19 |
| 4,017,076 | 4/1977 | Bai | 273/346 |

FOREIGN PATENT DOCUMENTS

| | | | |
|---|---|---|---|
| 429313 | 5/1935 | United Kingdom | 273/412 |

OTHER PUBLICATIONS

Advertisement: "Sure Catch Every Time with Transogram's New Sticky Mitt" *Playthings* Periodical, Mar., 1964, vol. 62, #3, p. 443.

*Primary Examiner*—William H. Grieb
*Attorney, Agent, or Firm*—James J. Conlon

[57] ABSTRACT

A toy mitt is provided which also may be used as a stationary target, and includes a concave plastic shell having a number of suction cups located in the front portion and including a flexible strap attached on the backside and adjustable to conform to the size of the user's hand, or for attachment to a tennis racquet or the like. The adjustable strap may be removed and suction cups may be mounted on the back of the plastic shell for the purpose of securely mounting the shell in a permanent position where it may be used as a target to receive a thrown ball. The mitt is provided in a kit form which may be assembled by the user, and then partially disassembled to convert the mitt into a target or to otherwise attach the mitt to a stick, racquet or the like to improvise games and improve various strokes in games such as tennis.

8 Claims, 9 Drawing Figures

MITT AND TARGET FOR CATCHING A BALL

BACKGROUND OF THE INVENTION (1) Field of the Invention:

This disclosure pertains to a game device or toy which provides a mitt type of product that may be worn by the user or securely attached as a target game, or attached to a stick or the like for other types of games in which the concave portion can be used to receive a projectile such as a smooth surfaced ball.

(2) Description of the Prior Art:

Prior art devices, such as the Jackson et al., U.S. Pat. No. 3,141,173 (1964), provide a so-called catcher's mitt with an L-shaped, hollow cone with a number of suction cups mounted therein for the purpose of attaching themselves to a thrown, smooth ball. The Jackson mitt also includes a strap which is adapted to fit about the user's hand, and is permanently attached to the plastic shell. Unlike the applicant product, the hand-engaging strap of Jackson cannot be adjusted in length to fit snugly about a wearer's hand. Similarly, the strap of Jackson cannot be removed from the mitt to allow the mitt to be held by suction cup as a target device.

Another type of game device or target game is shown, the Lemelson U.S. Pat. No. 3,032,345 (1962). The Lemelson game discloses a ball type of projectile, FIG. 5, having patches of Velcro on the surface and adapted to be thrown at a target having a compatible fabric which will engage and adhere to Velcro on the projectile. Unlike the invention disclosed herein, the Lemelson patent does not disclose a hand-held mitt adapted to receive a projectile, and which can also be converted to a stationary target or attached to a stick, baseball bat, tennis racquet or the like to improvise other games.

SUMMARY

This disclosure pertains to a hand-held mitt type of device having a concave shape including a plurality of suction cups adapted to grasp a thrown ball. The mitt as it is called comes in a kit form and includes a flexible strap which fits about the back of the mitt member and can be attached to the mitt in a variety of ways to conform to various hand sizes of users. Thus, the mitt can be worn comfortably by children as well as adults. The mitt may also be used as a stationary target device by removing the flexible strap and placing suction cups in its place on the back of the shell to allow the mitt to be mounted to a smooth surface. Also, the mitt can be used with the flexible strap and attached to the strings of a tennis racquet or other type racquet. The suction cups provided include a short flexible neck, and a flexible cup which combine to allow the cup to deflect upon contact with the thrown object. This allows the suction cups to conform to the location of the thrown object and more easily grasp the object. The hand-held game device can be used by children for game purposes or can be used in special education classes to teach hand and eye coordination. Because all of the components of the product are water and moisture resistant, the game can also be played in the water where the suction properties are greatly improved.

The mitt may be provided in a kit form for assembly by the purchaser or user. Thus, the mitt may be assembled with a variety of suction cup arrangements to make catching a thrown ball easy (all suction cups attached), or more difficult (by attaching only a few suction cups). The strap may also be attached to provide a custom fit to the user's hand.

It is thus an object of this disclosure to provide a game device which may be used as a hand-held mitt by attachment to the user's hand with a flexible strap.

It is another object of this disclosure to provide a game device which can be mounted as a stationary target, and includes outwardly extending, a concave board area including a plurality of suction cups which may be attached in various members and configurations, and adapted to catch and hold a thrown object such as a smooth ball.

Another object of this disclosure is to provide a game in a kit form including a concave plastic shell having a number of openings and including a plurality of suction cups having an annular seat and locking rim to securely hold the suction cup in the openings of the plastic shell, yet allow the suction cups to be easily inserted and removed for the purpose of changing the application of the game or customizing the strap to fit the hand of the user.

Another object of this disclosure is to provide a game device with a plurality of suction cups and which includes a flexible strap which permits the shell to be attached to a racquet and thereby adapted to catch a thrown object or allow the user to practice a tennis stroke such as serves, side arms, returns and the like without retrieving the ball after it is struck.

These and other objects of the disclosure will become apparent to those having ordinary skill in the art with reference to the following description, drawings and appended claims.

DESCRIPTION OF THE PREFERRED EMBODIMENT

Figure 2:
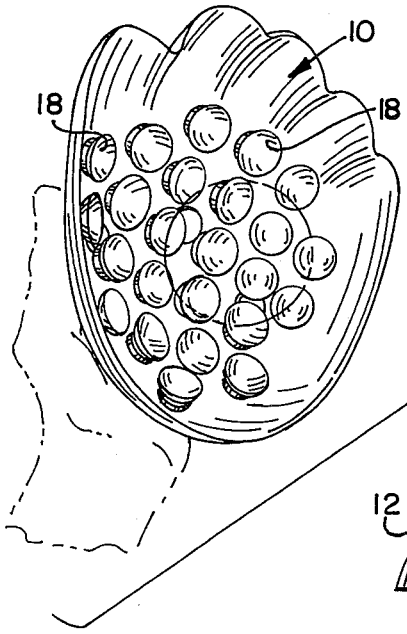
FIG. 2 is a view of the back of the mitt showing the elongated, adjustable strap.
Figure 1:
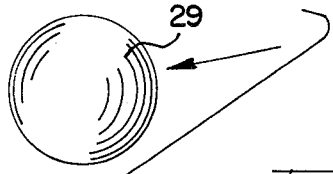
FIG. 1 is a pictorial illustration of the device shown in a hand-held position adapted to receive a ball.
Figure 6:
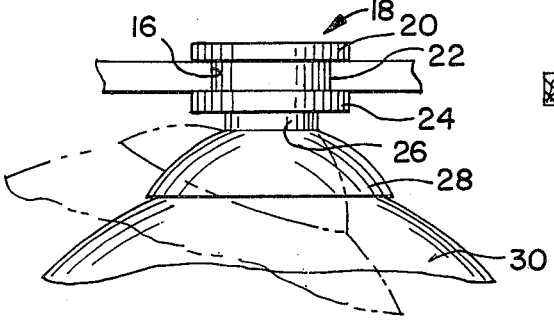
FIG. 6 is an enlarged illustration of the suction cup used.

Referring now to the drawings, and in particular to FIGS. 1 and 6, there is shown a concave, plastic dish 10, having a depressed bottom portion and upwardly extending edges 12, to thereby provide a bowl-shape to the dish 10. Dish 10 may be constructed of polyethylene. As shown in FIG. 2, a number of scoop portions 13, are molded integrally to dish 10 to provide an outline of a baseball mitt. Openings 16 are provided in the dish 10, and extend in rows from the bottom 14 upwardly along the side edges 12, and are adapted to receive suction members 18. Dish 10 resembles a bowl and has a periphery or outline which is disposed in a flat plane. This design provides a generally symmetrical product which may be more easily manufactured by injection molding with integral holes 16. With such a design, the mitt will cool down, after removal from the mold, at a uniform rate of shrinkage and distortion will be minimized.

As shown in FIG. 6, suction members 18 include a base 20, having an annular cutout or seat 22, adapted to fit in the openings 16. A base 20 is located on one side of the annular seat 22, and a locking rim 24 is located on the other side. Thus, when the suction member 18 is inserted into an associated opening 16, the locking rim 24 will be exposed to the concave portion of the dish 10, and base 20 will extend out and be in contact with the back of the dish 10. The top portion of the suction member 18 includes a molded cup 28, which is connected to the locking rim 24, by a short, flexible neck 26. As shown in FIG. 1, a smooth surfaced ball 29, is adapted to contact, flex and then be held by the resilient cup portion 28 of the suction member 18. The suction members 18 are manufactured from a copolymer manufactured by the B.F. Goodrich Company, and recognized by the name, Geon. Geon is recommended because it remains flexible over an extended period of time and is manufactured with plasticizers which migrate to the surface of the material over an extended period of time not only to retain the flexibility of the suction cups, but also to improve its grasping characteristics. Further, it is recommended that a smooth surfaced ball 29, be manufactured by any conventional method such as blow-molding or attaching to half-sections together with adhesive, ultrasonic welding, or a similar process. It is recommended that a 3-inch diameter ball be used with a suction member 18 with a cup 28, having a 7/16th's inch spherical radius and extending approximately 7/32nd's of an inch in depth.

Figure 4:
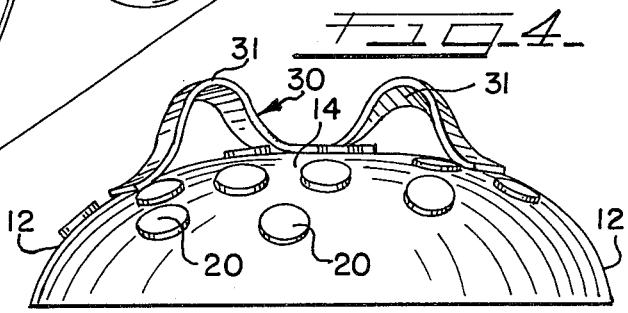
FIG. 4 is a top view of the device illustrated in FIG. 2.
Figure 5:
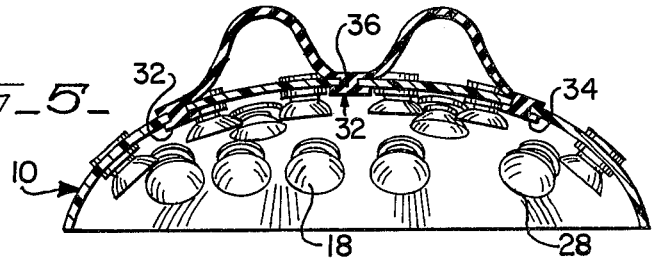
FIG. 5 is a sectional view taken generally along line 5—5 of FIG. 2.

One form of the recommended use of the product disclosed herein, involves the use of a flexible strap identified by the numeral 30, and also manufactured from Geon. As shown in FIG. 4, the strap 30 is attached to the back of the dish 10, in such a fashion that a pair of raised portions or loops are provided for the insertion of the user's fingers. Strap 30 includes three connectors 32, which are compatible with the openings 16, and allow the strap 30 to be affixed to the back of the dish 10 in such a fashion that the strap may be customized to fit the user's hand. Each strap 30 includes a washer portion 34, which extends through opening 16, and is located in the concave portion of dish 10. A short collar 36 is located in the opening 16, and is integrally molded to the strap 30.

Figure 8:
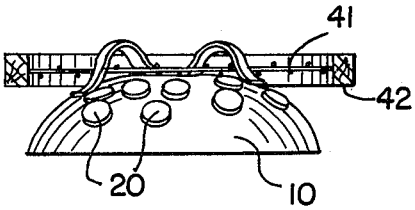
FIG. 8 is a top view of the mitt and racquet arrangement shown in FIG. 7.
Figure 7:
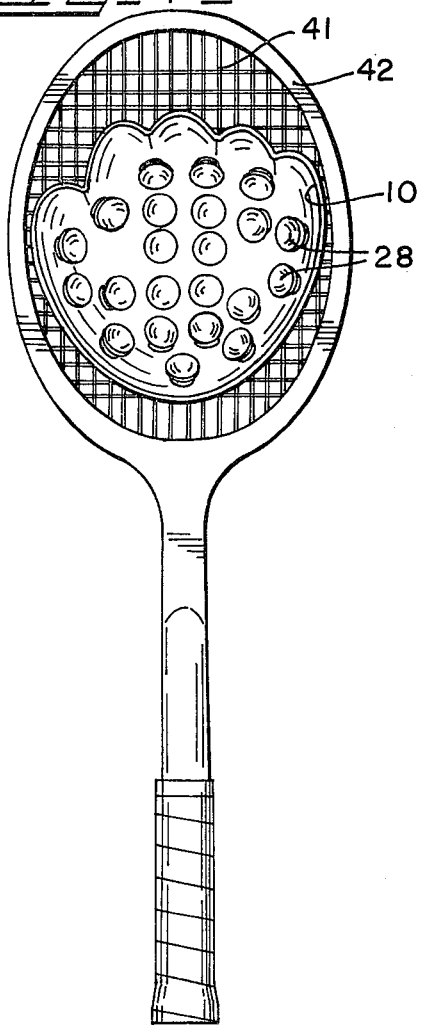
FIG. 7 shows the mitt attached to a tennis racquet.
Figure 9:
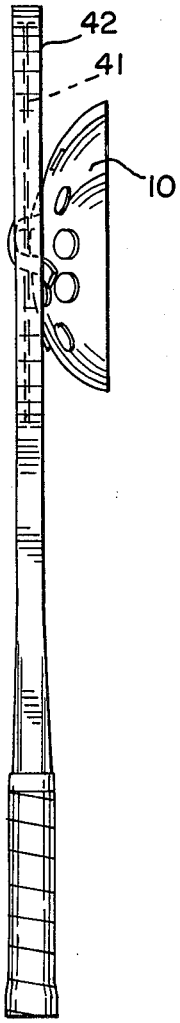
FIG. 9 is a side view of the mitt and racquet arrangement shown in FIG. 7.

Thus, it is shown that the strap can be affixed to the back of the dish 10, in such a fashion that the loops 31 are located very close to the dish or away from the dish so as to receive the fingers of the wearer. The flexible strap 30 also permits the dish 10 to be woven through the strings 41 of a racquetball racquet or tennis racquet 42, as shown in FIGS. 7–9. In such use, the dish and suction device can be used to practice other games such as tennis and racquetball, in order to develop eye-hand coordination and improve contact between a racquet and a ball without the inconvenience of having to chase the ball. Another advantage of attaching the dish 10 to a tennis racquet by use of the flexible strap 30 is that the ball 29, can be used for practicing a tennis serve. Thus, the person practicing may throw the ball in the air and while aloft, watch the ball carefully, and then make contact with the dish and suction cup in such a manner that the exact point of contact between the racquet and the ball can be determined because the ball will, of course, stick to the dish. Another advantage of attaching the dish 10 to a tennis racquet for improving one's serve is that there is a slight increase in air resistance as the racquet moves through the air, because the normal void formed between the strings in the racquet is no longer present and increased resistance is encountered by the user. This slight increase of resistance, helps to develop muscles used in serving a tennis ball, racquetball or the like.

Figure 3:
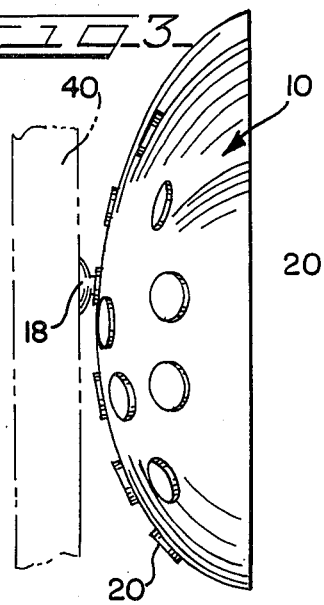
FIG. 3 is a side view of the device illustrated in FIG. 2, mounted to a wall as a stationary target game.
Figure 3:
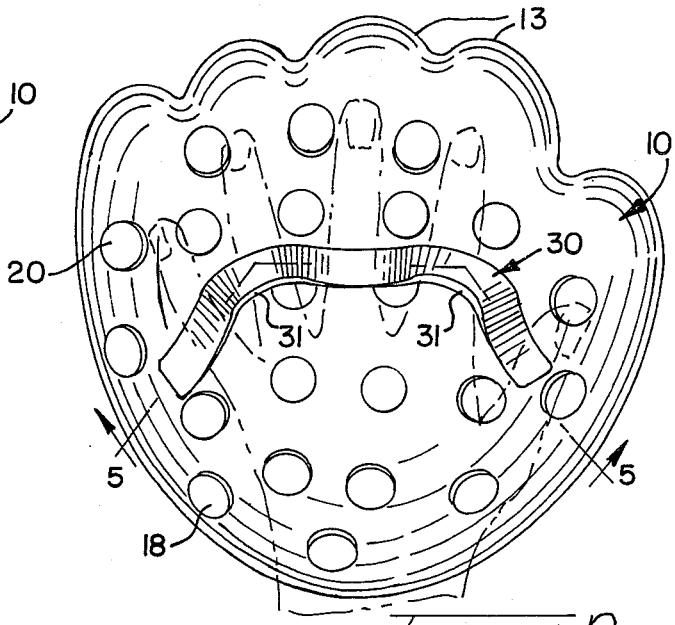

The embodiment shown in FIG. 3, shows how the game and device may be used as a target by removing the strap 30 and reversing the positioning of one or more of the suction members 18 to allow the dish to be securely attached to a wall, door or the like. It is contemplated that at least one suction member 18 be removed and reversed; however, it is also contemplated that a better adhesion could be accomplished between the dish 10 and wall 40 if several suction cups were removed and reversed in order to more securely hold and orient the dish device. One other feature of the embodiment shown in FIG. 3 is that the target can be located above the user's head and then angled downwardly be merely orienting suction cups at different locations. This allows a child to use the game and practice throwing the ball up to a height and at a distance over his head. It also allows the dish 10 to be oriented in a direction facing the person throwing the ball, and thus improves the catching and retaining characteristics of the target. It is contemplated that the dish 10 be manufactured from polyethylene. Thus, by manufacturing the dish and strap and suction members 18 from non-corroding material, the game can be used by people in the water when playing a type of water polo with a small ball.

It is anticipated that the components of the mitt be provided in a kit form. Thus, the dish 10 will be manufactured and packaged with a number of suction cups, twenty-four is the recommended number, which are inserted by the user in whatever openings are deemed appropriate. Some users may desire fewer than the recommended number and some may desire the full number of suction cups. The flexible strap 30 is also provided with the kit and can be attached to the shell 10 in order to customize the location of the strap for the wearers use. Some wearers may prefer to have the strap attached only at each end and not at an intermediate location to thus provide one large loop on the back of the shell 10. Other wearers may prefer to hold down the intermediate section of the strap to provide two adjacent loops to fit the fingers into. The flexible strap also can be woven into the strings of a tennis racket 42 or other racket type of member having openings. With such an arrangement the shell 10 can be securely attached to the racket. By utilizing the mitt attached to a tennis racket a server can quickly determine the point of contact for his or her serve depending on the point at which the ball 30 attaches to associated suction cups 28. For example, if the server is striking the ball too low, the ball 30 will be attached to suction cups 28 at the lower portion of the mitt.

From the foregoing, it has been shown that the mitt provided is a versatile member having improved gripping characteristics because of the uniquely designed suction cup 28. Also, because the strap cannot only be adjusted to fit the contour of the individual user's hand, but also be removed to allow the dish to be attached to a wall or racket or the like the very versatile product has been provided.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. A target and toy comprising a mitt adapted to catch a round, hollow ball having a smooth surface, the improvement comprising the combination of:

a dish member having a rim extending about the periphery thereof;

said dish member having a concave front and having a back;

said dish member having a plurality of openings therein;

suction cup means adapted to be located in the openings and thereby adapted to connect with said ball;

flexible strap with connecting means adapted to be removably attached to the back of said dish member for mounting said dish to a person's hand;

said flexible strap having attachment buttons located at each end;

said attachment buttons having collar means adapted to nest into said openings of the dish and also having a flexible washer portion adapted to fit through said openings and hold the strap in position.

2. The toy of claim 1 and said rim of the dish member providing:

said rim means extending in a common plane about the periphery of the dish.

3. The toy of claim 1 wherein said flexible strap comprises:

an elongated, ribbon-like member having an intermediate attachment button adapted to fit into an opening of the dish member to provide a pair of upstanding loops extending from the back of the dish and being adapted to fit about a user's hand and assist in attaching the toy to a racket.

4. The toy of claim 1 wherein said flexible strap includes:

a molded plastic member having said attachment buttons formed integrally therewith.

5. The toy of claim 1 wherein said suction cup means includes:

a cup member having a lower bottom with curved sides extending upwardly and outwardly thereform;

said sides having a top periphery providing a thin, flexible edge adapted to easily conform with the outer surface contour of a thrown ball;

a connection providing an annular seat spaced between a base and a locking rim and adapted to conform with said openings and located the suction cups within the concave portion of the shell;

a neck extending between the locking rim and the suction cup and disposing the suction cup portion at a height above the locking rim to thereby permit movement of the suction cup to grasp a ball and allow the ball to be grasped by more than one suction cup at a time.

6. The toy of claim 1 and:

suction cup means adapted to be inserted into an opening on the back of said shell to fixedly mount the shell on a supporting surface.

7. A game toy and target kit having component parts adapted to be assembled by the user without special tools for providing a portable mitt and target which can be manually worn and manipulated and which can be mounted to a fixed surface to provide a target to receive and retain a ball, the kit comprising the combination of:

a plastic shell having a concave curvature providing a bowl-type depression, a back, and a periphery away from the depression, said periphery extending around the shell and having an undulating contour at one portion and having a plurality of openings extending through the shell and adapted to receive the ball;

resilient suction means adapted to be inserted into the openings extending through the shell, each suction means having a cup portion supported on a resilient neck which allows the cup portion to be movable and adapt to the direction of travel of a ball whereby a plurality of suction means will simultaneously contact and grip a ball, said resilient suction means also having connection means providing an annular portion surrounded by a base and a washer portion with the base adapted to resiliently be deformed to fit through an associate opening for attachment to the plastic shell;

resilient strap means comprising an elongated strap with attaching means at each end and intermediate each end, and having connecting protrusions adapted to be inserted into openings in the plastic shell in such a fashion that the strap protrudes above the back of the plastic shell to form loops to receive fingers of a person, said strap means being detachable and replaceable by suction means extending from the back of the plastic shell to thereby allow the shell to be removable and attached to a supporting surface and form a target.

8. The game toy and target kit of claim 7 wherein said resilient suction means includes:

a cup member having a lower bottom with curved sides extending upwardly and outwardly thereform;

said sides having a top periphery providing a thin, flexible edge adapted to easily conform with the outer surface contour of a thrown ball;

a connection providing an annular seat spaced between a base and a locking rim and adapted to conform with said openings and located the suction cups within the concave portion of the shell;

a neck extending between the locking rim and the suction cup and disposing the suction cup portion at a height above the locking rim to thereby permit movement of the suction cup to grasp a ball and allow the ball to be grasped by more than one suction cup at a time.

* * * * *